United States Patent [19]

Schnabel, Jr.

[11] 4,106,225

[45] Aug. 15, 1978

[54] METHOD AND APPARATUS FOR EXCAVATING UNDERPINNING HOLES

[75] Inventor: Harry Schnabel, Jr., Bethesda, Md.

[73] Assignee: Schnabel Foundation Company, Washington, D.C.

[21] Appl. No.: 775,115

[22] Filed: Mar. 7, 1977

[51] Int. Cl.[2] ..... B66C 3/02; E02D 5/00

[52] U.S. Cl. ..... 37/184; 37/195; 61/51; 173/43; 173/28; 212/42.5

[58] Field of Search ..... 37/182–188, 37/195, 103; 175/238, 161; 173/43, 53, 28; 212/42, 42.5, 44, 81, 84, 127, 129, 144, 8 A, 54, 55; 61/51

[56] References Cited

U.S. PATENT DOCUMENTS

| | | | |
|---|---|---|---|
| 1,218,826 | 3/1917 | Armstrong | 37/182 |
| 1,507,236 | 9/1924 | Humiston | 37/182 UX |
| 1,518,757 | 12/1924 | Reid, Jr. | 37/184 X |
| 2,664,652 | 1/1954 | Talboys | 37/195 |
| 2,743,904 | 5/1956 | Scott | 173/43 X |
| 2,822,147 | 2/1958 | Allard | 175/161 |
| 3,157,235 | 11/1964 | Raizk et al. | 173/53 |
| 3,194,329 | 7/1965 | Wallers | 37/183 R X |
| 3,240,278 | 3/1966 | Witwer | 173/43 X |
| 3,726,349 | 4/1973 | Heusler et al. | 175/238 X |
| 3,888,317 | 6/1975 | Walters | 173/43 |

FOREIGN PATENT DOCUMENTS

| | | | |
|---|---|---|---|
| 2,448,881 | 4/1976 | Fed. Rep. of Germany | 37/103 |
| 1,200,575 | 7/1970 | United Kingdom | 37/183 R |

*Primary Examiner*—Clifford D. Crowder

[57] ABSTRACT

An underpinning excavator which comprises a crane having a horizontal beam and a boom extending angularly upwardly and outwardly above the beam and a digging assembly which includes a vertical rod suspended from the boom and a clamshell digger affixed to the bottom of the rod, the rod being engaged by means on the horizontal beam to move the rod inwardly or outwardly along the beam and to rotate the rod about its own axis to effect the excavation of an opening contiguous to and at least partially under the wall to a sufficient depth to permit underpinning to be installed.

14 Claims, 3 Drawing Figures

19
34
35
18
3
3
36
33
31
29
27
37
28
30
40
15
26
40
17
32
19
39
43
42
44
41
24
25
21
22
23
25

METHOD AND APPARATUS FOR EXCAVATING UNDERPINNING HOLES

BACKGROUND OF THE INVENTION

The invention relates to earth excavating and more particularly to the excavation of holes underlying existing building walls to permit underpinning to be constructed to support the building.

In order to construct underpinning beneath an existing building, holes must be excavated at least partially underlying the building wall to enable the underpinning to be placed under the wall.

In prior art technques for excavating underpinning holes, it has usually been necessary to perform a substantial amount of the excavation manually. First, a hole is usually dug contiguous to a building wall and as the excavation proceeds downwardly, it must be extended laterally under the bottom of the wall in order to accommodate the underpinning. The portion of the excavation which underlies the wall is difficult and inconvenient to perform by machine. As a consequence, it has generally been necessary to position laborers in the hole who remove the earth from beneath the wall by utilizing hand tools.

Such manual excavation is slow and expensive. In certain soil conditions, such as wet sand, manual digging is attended by a significant danger of cave-in or collapse. The conventional practice of reinforcing excavations by partial filling with drilling muds, such as bentonite slurries, cannot normally be employed when laborers are present in the excavation.

SUMMARY OF THE INVENTION

A general object of the present invention is to provide a completely mechanized method and apparatus for excavating underpinning holes under existing structures.

A more specific object of the invention is to provide such an apparatus in which a clamshell digger can be moved, first, downwardly contiguous to a building wall and then inwardly under the foundation wall to excavate under the wall with the digging apparatus being accurately and effectively controlled throughout the digging operation.

To accomplish these and other objects, the invention broadly encompasses an excavator for digging and removing earth from a hole extending beside and at least partially under a structure to be underpinned. The excavator includes a vertical rod, earth removing digger means affixed to the bottom of the rod and means for suspending the rod above the hole and for moving the rod vertically to permit the digger means to descend into and ascend out of the hole.

The digger means has a substantial horizontal reach from the rod to extend a substantial distance under the structure when suspended in the hole with the rod adjacent the structure.

Reciprocable means engage the rod to move it horizontally toward the structure to position the digger means under the structure and away from the structure to permit the digger means to ascend out of the hole clear of the structure.

The invention also encompasses a method of excavating a hole extending beside and at least partially under a structure to be underpinned. According to the method, a vertical rod is suspended with earth removing digger means affixed to the bottom of said rod and having a substantial horizontal reach from the rod to extend a substantial distance under the structure when suspended in the hole with the rod adjacent the structure. The rod is moved horizontally toward the structure to position the digger means under the structure. The rod is lowered and the digger is operated to excavate downwardly under the structure. The rod is then raised to move the earth bearing digger means to a location near the bottom of the structure. At that point, the rod is moved horizontally away from the structure until the digger clears the structure and then is further raised to remove the digger from the hole and to dispose of the removed earth.

DESCRIPTION OF THE PREFERRED EMBODIMENT

Figure 1:
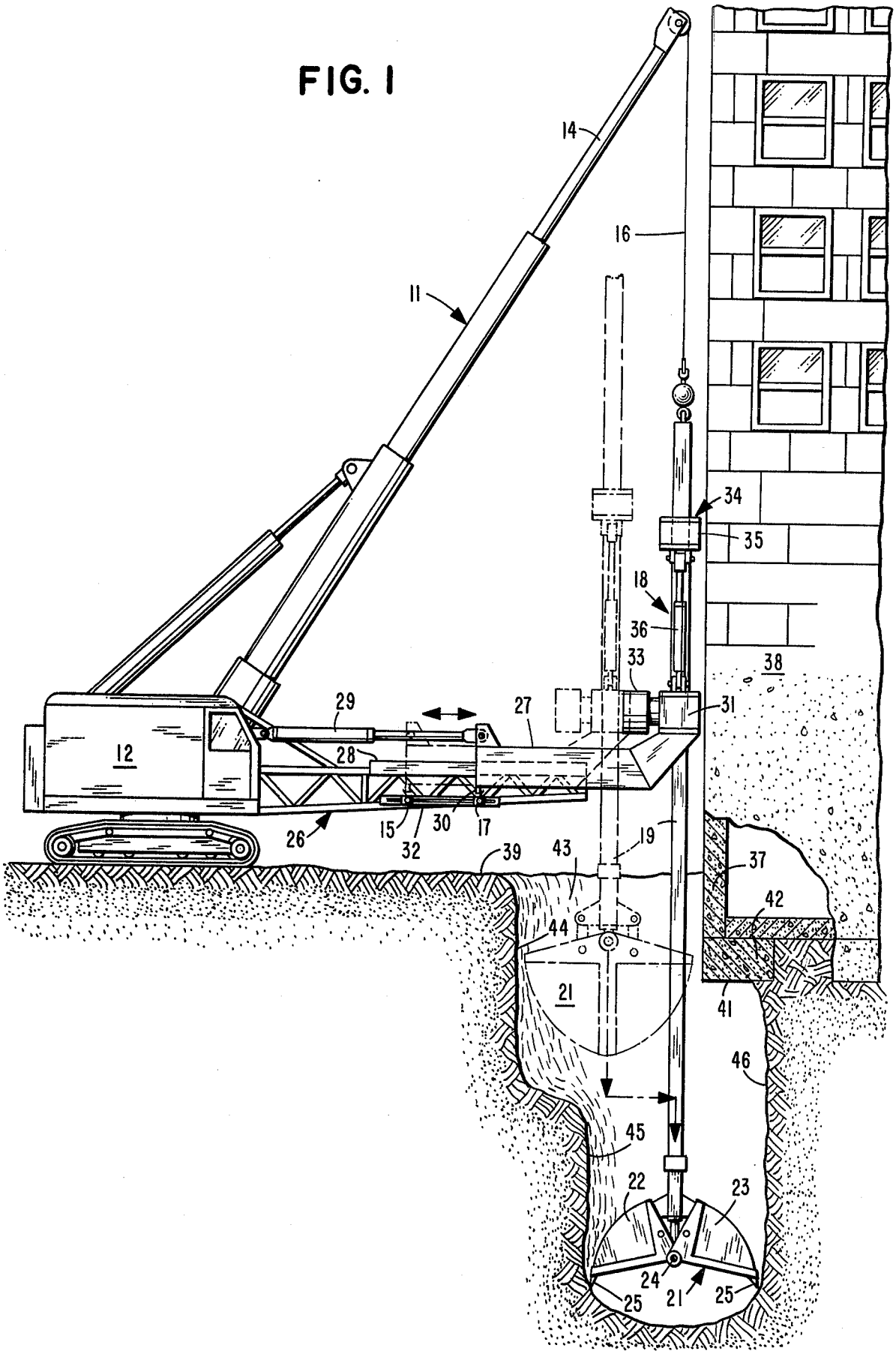
FIG. 1 is a side elevation of an apparatus according to the invention.
Figure 2:
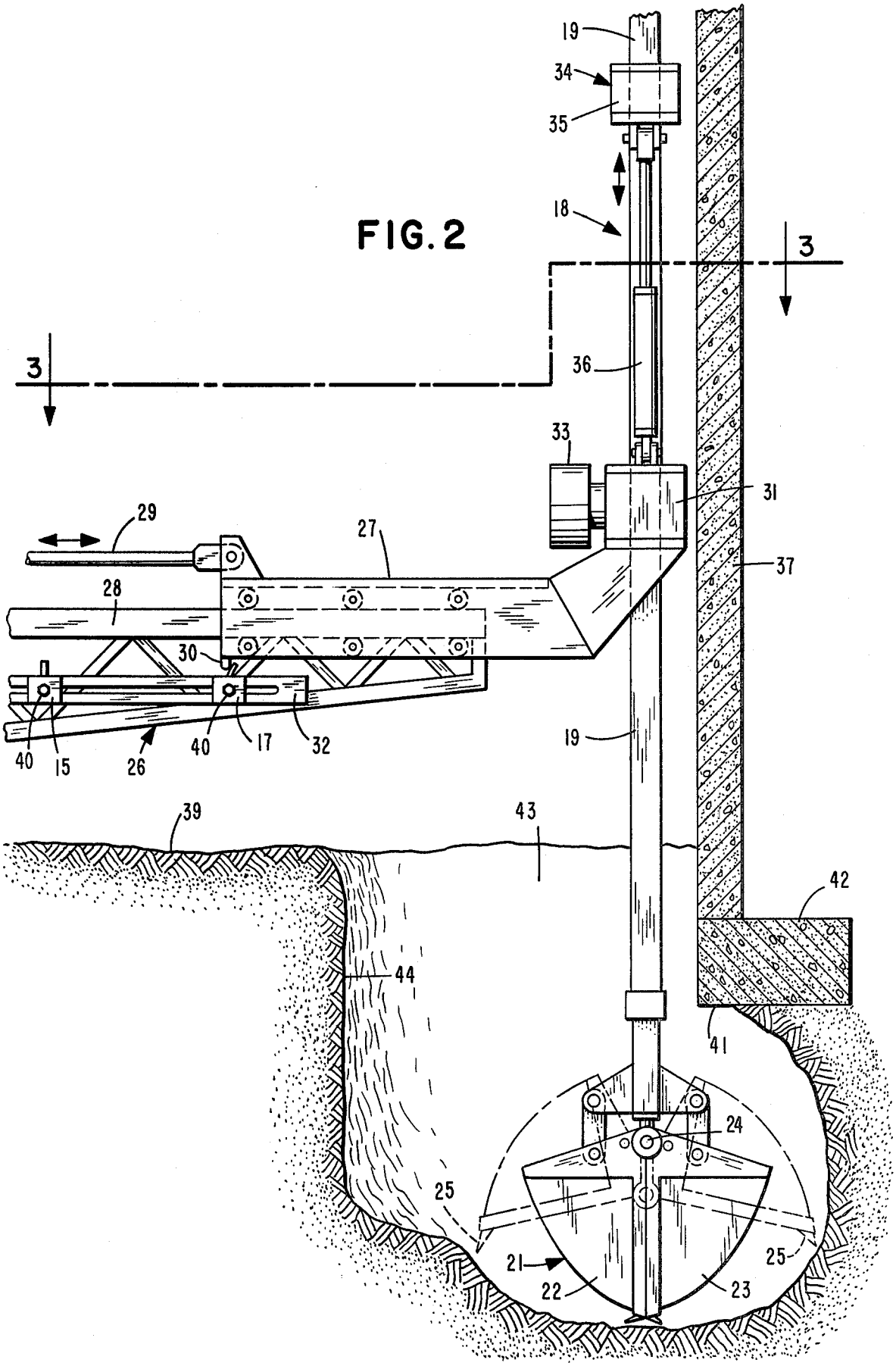
FIG. 2 is a fragmentary side elevation to an enlarged scale showing the digging assembly and the rod restraining beam.

There is illustrated in the drawing a crane 11 embodying a hydraulic boom 14 which extends angularly upwardly and outwardly from the crane. The boom can be telescopically raised and lowered and swung horizontally in the usual manner about a vertical axis by conventional mechanisms (not shown). Extending from the top of the boom 14 is a lifting cable 16 which can be raised or lowered by a conventional power mechanism (not shown). By extending or contracting the boom, the cable can be suspended a desired distance from the building.

Suspended from the outer end of the boom 14 by the cable 16 is an excavating assembly 18 which includes a rigid, preferably square, rod 19 which may be constructed of steel or similar material. Affixed to the bottom of the rod 19 is a conventional clamshell digger 21 which includes buckets or digging elements 22 and 23. The buckets 22 and 23 rotate about a horizontal axis 24. The outer ends 25 of the buckets have the usual digging teeth attached thereto. The operation of the buckets provides the digger with a horizontal reach substantially larger than the rod. Thus, when the digger is lowered below the bottom of the wall, the rod may be moved contiguous to the wall so that the digger extends a substantial distance under the wall.

Extending horizontally outwardly from the carriage 12 of the crane 11 is a beam 26 which is mounted in cantilever fashion to the carriage. Preferably, the beam 26 is supported by the carriage 12 independently of the boom 14. However, the outer end of the beam 26 may be supported, in whole or in part, by the boom 14 but by means independent of the cable 16 which suspends the digging assembly. A platform 27 is mounted at the outer end of the beam 26 and is supported by such beam. The platform 27 is slidable horizontally along the beam on a track 28. The platform 27 is movable inwardly and outwardly along the track 28 by a hydraulic cylinder 29 which is controlled from the carriage 12 by conventional means (not shown). A pair of microswitches 15 and 17 are engageable by a protrusion 30 on the platform 27. The engagement of microswitches 15 and 17 by the protrusion 30 on the inward and outward strokes of the platform 27 causes the hydraulic cylinder 29 to stop the platform. The location and spacing of the microswitches can be adjusted to fix the limits of the stroke to a desired distance for each particular job. Thus, the microswitches are slidably mounted on a slotted bar 32, which is attached to the bearing 26, and the switches can be fixed at desired locations along the bar 32 by set screws 40.

Figure 3:
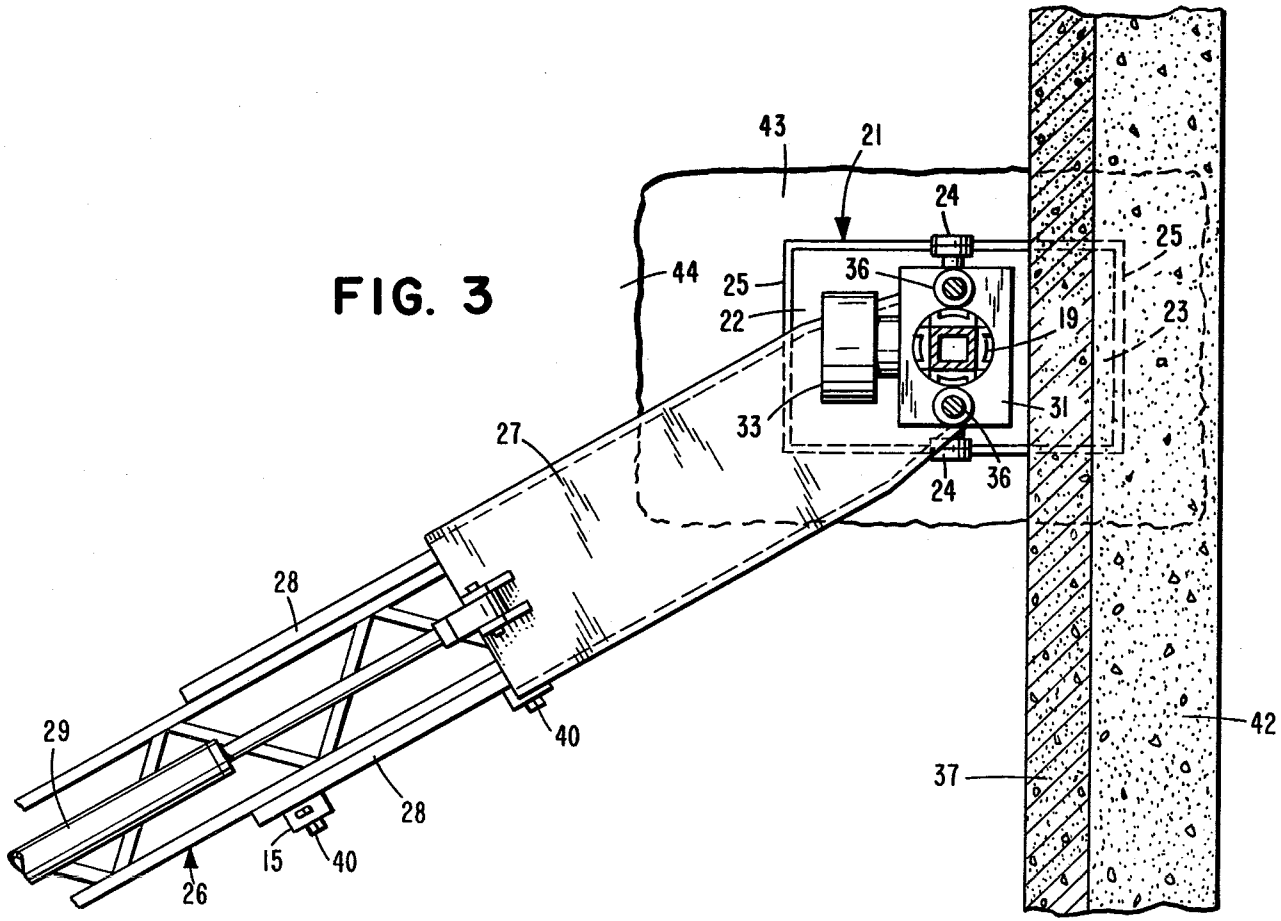
FIG. 3 is a vertical sectional view taken along the lines 3—3 of FIG. 2.

Affixed to the outer end of the platform 27 is a square guide mechanism 31 which orients and horizontally restrains the square vertical rod 19 (FIG. 3). The guide 31 is connected to a rotary mechanism operated by a hydraulic motor 33 which is controlled from the carriage 12. With the guide 31 orienting the rod 19, actuation of the motor 33 causes the rotary mechanism to rotate the rod 19 about its own axis in either direction. Thus, the horizontal digging line along which the clamshell buckets 22 and 23 operate, may be angularly adjusted to the proper orientation relative to the beam 26. The guide 31, while properly orienting the rotational position of the rod 19 and restraining such rod from horizontal movement, permits the rod to move vertically relative to the guide 31. As a consequence, the rod may be raised and lowered through the opening in the guide 31 by raising or lowering the cable 16. The digging mechanism may be lowered by gravity alone. However, a power-operated down thruster 34 is supported on the platform 27 to provide an additional downward power thrust to the rod 19. The down thruster 34 includes a grab 35 which surrounds the rod 19 and is capable of selectively gripping or releasing the rod by a conventional mechanism (not shown). The grab 35 is moved upwardly or downwardly by a pair of hydraulic cylinders 36 which are affixed to the outer end of the platform 27. The grab 35 and the hydraulic cylinders 36 are actuated by means (not shown) located in the carriage 12.

In operation, the crane 11 is moved to a position in which the beam 26 is pointed toward a wall 37 of a building structure 38 to be underpinned. Typically, the wall 37 extends downwardly below the surface 39 of the ground. The bottom 41 of the wall 37 is defined by a footing 42. Although the crane 11 is located with the beam 26 generally perpendicular to the wall 37, in practice it is frequently inconvenient and, at times, impossible for the beam to be oriented precisely perpendicular to the wall. Thus, as shown in exaggerated fashion in FIG. 3 for clarity, the beam 26 may be oriented at a slight angle to the perpendicular. To compensate for that variation, the guide 31 is actuated to rotate the rod 19 about its own axis until the digging line of the clamshell buckets 22 and 23 is oriented sustantially perpendicular to the wall 37. When the crane is initially moved up to the wall to be underpinned, the clamshell digger 21 is located above the surface of the ground close to the wall 37. Further, positioning of the digger may be effected by telescoping adjustment of the boom 14 and beam 26 until the outermost digging bucket 23 just clears the wall when it is fully extended. In that position, with the digging line oriented perpendicular to the wall, the apparatus is in condition for the excavation to proceed. The clamshell digger 21 is then operated in conventional fashion to excavate the upper vertical portion of a hole 43. Initially, the upper earth wall 44 of the excavation is spaced from the building wall 37 a distance at least equal to the full reach of the buckets 22 and 23. The digging proceeds with the digging assembly being moved downwardly by gravity, with or without a power-assist, along the same line until the top of the digger 21 is lower than the bottom 41 of the wall 37. At that point, the digger may be moved up and down against the rear wall of the hole with the buckets open and progressively moved inwardly to cut a series of vertical slices. The inward horizontal movement is effected by intermittent actuation of the hydraulic cylinder 29 to move the guide 31 and consequently, the rod 19 outwardly of the beam 26 toward the wall 37 as each slice is cut. The progressive slicing action and outward movement of the digger by the hydraulic cylinder 29 is continued until the excavation underlies the wall 37 to the desired distance up to a point where the furthest protruding point of the apparatus above the ground is as close as desired to the wall 37. At that point, the outward movement of the hydraulic cylinder 29 is stopped and straight vertical excavation is resumed to form the lower vertical portion of the underpinning hole defined by earth walls 45 and 46. The lower portion of the hole at least partially underlies the bottom of the wall 37. The digger is operated to scoop out the earth and then is raised with the buckets closed to remove the earth. When the rising digger draws close to the bottom 41 of the wall, the hydraulic cylinder 29 is actuated to move the rod 19 away from the wall 37 until the digger is entirely outside of the wall. The digger is then further elevated until it clears the top of the hole. The crane is swung horizontally and the removed earth is deposited. The crane is then swung back into position with the digger over the hole. The digger is lowered into the hole until it is below the wall, moved inwardly under the wall by the cylinder 29, and then downwardly to the bottom of the hole. The vertical excavation continues by repeating the above steps until the desired depth is reached.

If desired, the hole may be started by manually excavating the initial vertical portion of the hole outside of the wall and the horizontal portion just under the wall so that the digger mechanism of the invention is used only to excavate the vertical portion of the hole underlying the wall. Alternatively, both the upper and lower vertical portions of the hole may be excavated by the digger mechanism and the horizontal portion just below the wall can be dug by hand.

The mechanized method and apparatus of the present invention is substantially more convenient, efficient and inexpensive than the manual techniques heretofore employed. Moreover, if desired, a drilling mud, such as a bentonite slurry, may be placed in the excavation as it proceeds in order to minimize cave-ins and otherwise to protect the integrity of the open excavation. Such a drilling mud normally could not be employed if it were necessary to have laborers in the excavation as it proceeds.

Although the invention has been illustrated and described with reference to a particular preferred embodiment, it will be understood that various modifications may be employed without departing from the scope of the invention which is defined by the appended claims.

I claim:

1. An excavator for digging and removing earth from a hole extending beside and at least partially under a structure to be underpinned which comprises:

a vertical rod;

earth removing digger means affixed to the bottom of said rod;

means for suspending said rod above the hole and for moving the rod vertically to permit said digger means to descend into and ascend out of the hole;

said digger means having a substantial horizontal reach from said rod to extend a substantial distance under the structure when suspended in the hole with the rod adjacent the structure;

reciprocable means engaging said rod to move said rod and said digger means linearly in a horizontal direction toward and away from the structure;

said digger means including a digging element movable in the direction of said horizontal reach; and means to position said digger means relative to said reciprocable means and the structure so that the direction of said linear horizontal movement of said rod and said digger means is parallel to the direction of said horizontal reach.

2. An excavator according to claim 1 wherein said digger means comprises a clamshell digger.

3. An excavator according to claim 1 wherein said means to position said digger means comprises means for moving said digger means in any one of two opposite directions to selective positions, wherein the direction of said linear horizontal movement of said rod and said digger means is disposed at an angle to the direction of said horizontal reach.

4. An excavator according to claim 3 wherein said means for moving said digger means comprises means to selectively rotate said rod about its own axis to orient said digger means relative to the structure.

5. An excavator for digging and removing earth from a hole extending beside and at least partially under a structure to be underpinned which comprises:

a vertical rod;

earth removing digger means affixed to the bottom of said rod;

means for suspending said rod above the hole and for moving the rod vertically to permit said digger means to descend into and ascend out of the hole;

said digger means having a substantial horizontal reach from said rod to extend a substantial distance under the structure when suspended in the hole with the rod adjacent the structure;

reciprocable means engaging said rod to move said rod horizontally toward the structure to position said digger means under the structure and away from the structure to permit the digger means to ascend out of the hole clear of the structure; and control means for automatically and adjustably limiting the stroke of said reciprocable means to permit said rod and said digger means to automatically reach their preset limits of horizontal movement both adjacent to and remote from the structure prior to initiation of vertical movement by said suspension means.

6. An excavator according to claim 5 wherein said digger means comprises a clamshell digger.

7. An excavator according to claim 6 further comprising means to selectively rotate said rod about its own axis to orient said digger relative to the structure.

8. An excavator for digging and removing earth from a hole extending beside and at least partially under a structure to be underpinned which comprises:

a vertical rod;

earth removing digger means affixed to the bottom of said rod;

means for suspending said rod above the hole and for moving the rod vertically to permit said digger means to descend into and ascend out of the hole;

said digger means having a substantial horizontal reach from said rod to extend a substantial distance under the structure when suspended in the hole with the rod adjacent the structure;

reciprocable means engaging said rod to move said rod horizontally toward the structure to position said digger means under the structure and away from the structure to permit the digger means to ascend out of the hole clear of the structure; and power operated grab means to thrust said rod vertically downwardly to facilitate said excavation.

9. An excavator according to claim 8 wherein said digger means comprises a clamshell digger.

10. An excavator according to claim 9 further comprising means to selectively rotate said rod about its own axis to orient said digger relative to the structure.

11. An excavator for digging and removing earth from a hole extending beside and at least partially under a structure to be underpinned which comprises:

a crane having a generally horizontal beam and a boom extending angularly upwardly and outwardly above said beam;

a vertical rod suspended from said boom;

earth removing digger means affixed to the bottom of said rod and having a substantial horizontal reach from said rod to extend a substantial distance under the structure when suspended in the hole with the rod adjacent the structure;

means to move the rod vertically to permit said digger means to descend into and ascend out of the hole;

reciprocable means mounted on said beam and engaging said rod to move said rod and said digger means horizontally in a direction parallel to the axis of said beam toward and away from the structure;

said digger means including a digging element movable in the direction of said horizontal reach;

means to position said digger means relative to said reciprocable means and the structure so that the direction of horizontal movement of said rod and said digger means is parallel to the direction of said horizontal reach.

12. An excavator according to claim 11 wherein said means to position said digger means comprises means for moving said digger means in any one of two opposite directions to selective positions wherein the direction of horizontal movement of said rod and said digger means is disposed at an angle to the direction of said horizontal reach.

13. An excavator according to claim 12 wherein said digger means comprises a clamshell digger and said means for moving said digger means comprises means to selectively rotate said rod about its own axis to orient said digger means relative to the structure, and further comprising:

control means for automatically and adjustably limiting the stroke of said reciprocable means; and power operated grab means to thrust said rod vertically downwardly to facilitate said excavation.

14. A method of excavating to expand a hole extending beside and at least partially under a structure to be underpinned which comprises:

suspending over the hole a vertical rod with earth removing digger means affixed to the bottom of said rod and having a substantial horizontal reach from said rod toward the structure;

lowering the rod to position the digger means in the hole below the structure;

moving the rod horizontally toward the structure to position the digger means under the structure;

lowering the rod and operating the digger means to excavate downwardly under the structure;

raising the rod to move the earth-bearing digger means to a location near the bottom of the structure;

moving the rod horizontally away from the structure until the digger means clears the structure; and further raising the rod to remove the digger means from the hole and disposing of the removed earth.

* * * * *